US007652415B2

(12) United States Patent
Ramachandran et al.

(10) Patent No.: US 7,652,415 B2
(45) Date of Patent: Jan. 26, 2010

(54) ELECTRODE MATERIALS FOR ELECTRIC LAMPS AND METHODS OF MANUFACTURE THEREOF

(75) Inventors: Gopi Chandran Ramachandran, Bangalore (IN); Alok Mani Srivastava, Niskayuna, NY (US); Timothy John Sommerer, Ballston Spa, NY (US); Suchismita Sanyal, Kodihalli (IN); Prasanth Kumar Nammalwar, Karnataka (IN); Holly Ann Comanzo, Niskayuna, NY (US); William Winder Beers, Chesterland, OH (US); Madras Venugopal Shankar, Karnataka (IN)

(73) Assignee: General Electric Company, Niskayuna, NY (US)

( * ) Notice: Subject to any disclaimer, the term of this patent is extended or adjusted under 35 U.S.C. 154(b) by 737 days.

(21) Appl. No.: 11/254,991

(22) Filed: Oct. 20, 2005

(65) Prior Publication Data

US 2007/0090764 A1 Apr. 26, 2007

(51) Int. Cl.
*H01J 1/14* (2006.01)

(52) U.S. Cl. ..... 313/346 R; 313/634; 313/491

(58) Field of Classification Search ..... None
See application file for complete search history.

(56) References Cited

U.S. PATENT DOCUMENTS

| | | | | |
|---|---|---|---|---|
| 1,453,267 | A | 5/1923 | Bradford | |
| 2,180,988 | A | 11/1939 | Lemmers et al. | |
| 3,983,440 | A * | 9/1976 | Scott et al. | 313/566 |
| 3,988,629 | A * | 10/1976 | White et al. | 313/630 |
| 4,319,158 | A * | 3/1982 | Watanabe et al. | 313/346 R |
| 5,146,131 | A | 9/1992 | Derks | |
| 5,585,694 | A | 12/1996 | Goldburt et al. | |
| 5,744,905 | A | 4/1998 | Mehrotra et al. | |
| 5,847,498 | A | 12/1998 | Mehrotra et al. | |
| 6,211,615 | B1 * | 4/2001 | Altmann et al. | 313/631 |
| 6,218,025 | B1 * | 4/2001 | Fromm et al. | 428/544 |
| 6,353,289 | B1 | 3/2002 | Ishigami et al. | |
| 6,384,534 | B1 | 5/2002 | Srivastava et al. | |
| 6,541,899 | B1 | 4/2003 | Haverlag et al. | |
| 6,849,996 | B2 | 2/2005 | Venugopal et al. | |
| 6,879,091 | B2 | 4/2005 | Venugopal et al. | |
| 7,439,676 | B2 * | 10/2008 | Walser et al. | 313/618 |
| 2006/0132041 | A1 | 6/2006 | Choi | |

(Continued)

FOREIGN PATENT DOCUMENTS

| | | |
|---|---|---|
| EP | 1612899 | 1/2006 |

(Continued)

OTHER PUBLICATIONS

Hassan, F. E. et al, "Structural and Electronic Properties of Matlockite MFX (M=Sr, Ba, Pb; X=Cl, Br, I) Compounds", Journal of Physics and Chemistry of Solids 65, (2004) 1871-1878..

(Continued)

*Primary Examiner*—Ashok Patel
(74) *Attorney, Agent, or Firm*—Mary Louise Gioeni

(57) ABSTRACT

An electron emissive material comprises an alkaline earth metal halide composition and operable to emit electrons on excitation. A lamp including an envelope, an electrode including an alkaline earth metal halide electron emissive material and a discharge material, is also disclosed.

18 Claims, 6 Drawing Sheets

U.S. PATENT DOCUMENTS

2007/0182332 A1* 8/2007 Haacke et al. ..... 313/633

FOREIGN PATENT DOCUMENTS

| | | |
|---|---|---|
| EP | 1650785 | 4/2006 |
| GB | 2181887 | 4/1987 |

OTHER PUBLICATIONS

Hagemann, H. et al, "Study of the Solid-Liquid Equilibrium in Mixed Alkaline Earth Fluorohalides", Journal of Thermal Analysis and Colorimetry, vol. 57 (1999) 193-202.

Petrescu, P. et al., "Electron Emissions Soectra of Alkaline Earth Fluorides", Physic Status Solidi, (1970), 113-118, XP-002456462.

Petrescu, P. et al., Evidence for Intrinsic Color Centres Emission Spectra of BaC12 and SrC12 B Barium Compounds; Color Centres; Photoemission; Strontium Compounds, Physica Status Solidi (1970) vol. 37, K5-K7, XP002456463.

Gould, R.D. et al., "Forming, Negative Resistance and Dead-time Effects in Thin Films of CaBr2", Physica Status Solidi, (Jun. 16, 1974), 531-535, XP-002456464.

Fujii, M. et al., "Secondary Electron Emission from MgF2", Memoirs of the Faculty of Engineering, Osaka City University, (Dec. 1967), 151-157, XP-002456465.

Petrescu, P. et al., "Electron Emission Spectra of Alkaline Earth Fluorides", Phys,. State. Solid 38, 113 (1970), 113-118, XP-009089552.

* cited by examiner

ELECTRODE MATERIALS FOR ELECTRIC LAMPS AND METHODS OF MANUFACTURE THEREOF

BACKGROUND

Embodiments of the invention relate generally to electron emissive materials and in particular to electrode materials for electric lamps.

Electron-emissive mixtures containing alkaline earth oxides, specifically barium oxide, have been typically used in mercury discharge lamps. However, the use of barium oxide in metal halide discharge lamps poses certain challenges. The use of barium oxide as a component of lamp electrodes, especially in low-pressure metal halide discharge lamps, is expected to lead to performance issues. This is at least in part due to the reaction of the halide with barium oxide, which can lead to the formation of barium halide. For example, a metal halide discharge material such as indium bromide may react with an emission material such as barium oxide to form barium bromide and indium oxide. It is advantageous to avoid such a deleterious reaction in discharge lamps involving the metal halide emission material, as it may lead to a reduction in the lumen output and life of the lamp.

Typical electron emissive coatings currently used in association with electrodes in many commercial fluorescent lamps contain a mixture of barium, calcium, and strontium oxides ("triple oxide emissive mixture"). Since these oxides are highly sensitive to ambient carbon dioxide and water, they are generally coated on the lamp electrodes initially as a wet mixture suspension of barium, calcium and strontium carbonates containing a binder and a solvent. The wet mixture suspension is then "activated" inside the lamp assembly during the manufacturing process. Activation includes converting the carbonate into an oxide typically by resistively heating the electrodes until the carbonates decompose, releasing carbon dioxide and some carbon monoxide, and leaving behind a triple oxide emissive mixture on the electrode. However, the release of carbon dioxide and carbon monoxide can be disadvantageous as it may lead to changes in the discharge dynamics causing lower luminescence of the lamp. Activation further includes processing the material to a state required for electron emission. Incomplete activation may lead to lamp performance issues like higher ignition voltage, premature cathode breakdown, and loss in light output due to early wall darkening.

Therefore, there is a strong need for electron emissive materials which address one or more of the foregoing problems.

BRIEF DESCRIPTION

One aspect of the present invention includes an alkaline earth metal halide composition operable to emit electrons on excitation.

Another aspect of the present invention includes an electrode having an electron emissive material including an alkaline earth metal halide composition.

Yet another aspect of the present invention includes a lamp including an envelope, having an electron emissive material including an alkaline earth metal halide composition and a discharge material.

A further aspect of the present invention including a method of manufacturing an electron emissive system including the steps of providing an electrode substrate, providing an alkaline earth halide electron emissive material, and disposing the electron emissive material over the substrate.

In a still further aspect of the present invention is a method of operating a lamp comprising thermally or electrically exciting an alkaline earth halide electron emissive material disposed within a lamp by operably coupling the lamp to an excitation source and supplying thermal or electrical energy to cause the electron emissive material to emit electrons.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
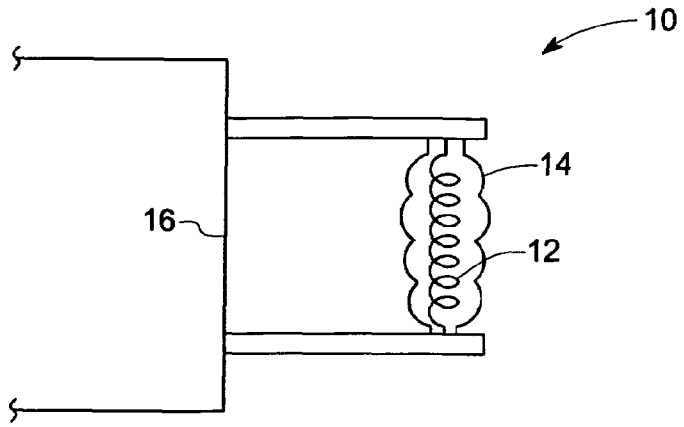
FIG. 1 is a side cross-sectional view of a coil electrode having the electron emissive material in accordance with certain embodiments of the present invention.

Embodiments of the present invention disclose a composition including an alkaline earth metal halide that is operable to emit electrons in response to an excitation. As used herein, the term "alkaline earth metal halide composition" refers to any material composition that includes at least some quantity of alkaline earth metal and at least some quantity of halogen. Moreover, as used herein, the term "electron emissive material" refers to any material that includes at least one such alkaline earth metal halide composition. The compositions described herein may emit electrons in response to various excitations such as, but not limited to thermal excitation and electrical excitation. Use of such electron emissive alkaline earth metal halide compositions may be especially advantageous in systems where such compositions do not react with other materials to unfavorably alter properties of the system. In particular, an electron emissive material as descried herein may be especially useful as an emitter material in lamps. For example, in an indium iodide discharge lamp, an alkaline earth metal halide composition of barium iodide is expected to not react with an indium iodide discharge material, thus avoiding any loss in luminescence due to loss of indium iodide, which is primarily responsible for the luminescence of the lamp.

In one embodiment of the present invention, an alkaline earth metal halide composition may be of the formula $$MXZ. \quad (1)$$

As used with respect to formula (1) and throughout the following description, M is intended to represent at least one alkaline earth metal such as magnesium (Mg), calcium (Ca), strontium (Sr), or barium (Ba), or any combinations thereof, X is intended to represent a first halogen such as fluorine (F), chlorine (Cl), bromine (Br), or iodine (I) or any combinations thereof, and Z is intended to represent a second halogen such as F, Cl, Br, or I or any combinations thereof. In some embodiments, a composition of formula (1) above may be stoichiometric, where the composition is charge balanced. Charge balancing results in there being no net charge on the composition. In other embodiments, such a composition may be non-stoichiometric. For example, such an alkaline earth metal halide composition may have some halogen deficiency such that the excess metal may provide doping and increased electrical conductivity. In certain embodiments, X and Z may comprise the same type of halogen, such as in barium fluoride ($BaF_2$). In certain other embodiments, X and Z may be different halogens, such as in barium fluoroiodide (BaFI). Examples of electron emissive materials according to the formula MXZ of the present embodiment include but are not limited to $BaF_2$, BaFI, BaFCl, BaFBr, BaClI, BaClBr, BaIBr, $BaI_2$, $SrF_2$, SrFI, SrFCl, SrFBr, SrClI, SrClBr, SrIBr, $SrI_2$, $CaF_2$, CaFI, CaFCl, CaFBr, CaClI, CaClBr, CaIBr, $CaI_2$, $MgF_2$, MgFI, MgFCl, MgFBr, MgClI, MgClBr, MgIBr, $MgI_2$, $Ba_{0.5}Ca_{0.5}FI$, $Ba_{0.5}Ca_{0.5}F_2$, $Sr_{0.3}Ca_{0.7}ClI$, and $Mg_{0.1}Sr_{0.5}FBr$.

In another embodiment of the present invention, the alkaline earth metal halide composition may be an alkaline earth metal oxyhalide. In one example, such a metal oxyhalide may be a MXZ halide with fractional substitution of halogen with oxygen. In some embodiments, the alkaline earth metal oxyhalide may be represented by $$MX_lZ_mO_{n/2}, \quad (2)$$

where $0 \leqq 1 \leqq 2$; $0 \leqq m \leqq 1$ and $n \leqq 0.5$, wherein l, m, and n may be selected to maintain charge balance. In some embodiments, the alkaline earth metal halide composition of formula 2 may be stoichiometric, wherein the composition is charge balanced. As mentioned above, charge balancing results in there being no net charge on the composition. In some other embodiments, the alkaline earth metal halide composition may be non-stoichiometric. For example, the alkaline earth metal halide composition may contain some halogen or oxygen deficiency such that the resulting excess metal may provide doping and increased electrical conductivity.

In a further embodiment of the present invention, the alkaline earth metal halide composition may be an alkaline earth halo oxynitride. Examples of alkaline earth halo oxynitrides include but are not limited to compositions of formula $$MX_bO_cN_d, \quad (3)$$

where b, c, d may be selected to maintain charge balance. In some embodiments, the composition may be stoichiometric, wherein the composition is charge balanced. In other embodiments, the composition may be non-stoichiometric. For example, an alkaline earth metal halide composition according to at least one embodiment of the present invention may contain some halogen, oxygen or nitrogen deficiency such that the resulting excess metal may provide doping and increased electrical conductivity. In some embodiments of the present invention, b may be selected to be in a range from greater than 0 to about 2, c may be selected to be in a range from 0 to about 1, and d may be selected to be in a range from 0 to about 1. In certain embodiments, b may be selected to be in a range from about 1 to about 2, c may be selected to be in a range from 0 to about 0.5, and d may be selected to be in a range from 0 to about 0.33. In one embodiment, the value of b, c and d may be so chosen that the composition is rich in halogen and contains small quantities of O and N. A non-liming example of such an alkaline earth halo oxynitride is $MX_{1.5}O_{0.1}N_{0.1}$.

In another embodiment of the present invention, the alkaline earth metal halide composition may include compositions of formula $$AeMfRgOhXi. \quad (4)$$

As used with respect to formula (4) and throughout the following description, A is at least one alkali metal such as sodium, or potassium, or combinations thereof, R is at least one metal such as La, Ce, Pr, Nd, Pm, Sm, Eu, Gd, Th, Dy, Ho, Er, Tm, Yb, Lu, Y, or Sc or any combinations thereof. In one embodiment e, f, g, h, I, may be selected so as to maintain charge balance. In some embodiments, the composition may be stoichiometric, wherein the composition is charge balanced. In other embodiments, the composition may be non-stoichiometric. For example, in some embodiments, e may be selected to be in a range from 0 to about 3, f may be selected to be in a range from greater than 0 to about 4, g may be selected to be in a range from about 0 to about 3, h may be selected to be in a range from 0 to about 1 and i may be selected to be in a range from about 2 to about 11. In certain embodiments i may be selected to be in a range from about 3 to about 10. In certain other embodiments, i may be selected to be in a range from about 5 to about 7. Examples of alkaline earth metal halide compositions of formula AeMfRgOhXi include but are not limited to MLnF5, A3MLnF8, MLnOF3, MLn2F8, MLn3F11, M2LnF7, M2Ln2F10, and M4Ln3F10, where Ln is a rare earth metal selected from the lanthanide series of rare earth metals.

In still another embodiment of the present invention, the alkaline earth metal halide composition includes Alkaline earth chloride fluoride orthophosphate $3Ca_3(PO_4)_2.CaClF$ or $3M_3(PO4)_2.MClF$.

The alkaline earth metal halide composition as provided in accordance with certain aspects of the present invention may be operable to emit electrons in response to a thermal or an electrical excitation. Thermal excitation leading to thermionic emission is the process by which materials emit electrons or ions upon application of heat. The work function of a material plays a role in determining the level of electron emission for a given thermal excitation. In some embodiments, the alkaline earth metal halide composition may also be capable of field emission. Field emission is a form of quantum tunneling in which electrons pass through a barrier in the presence of a high electric field.

In a further embodiment, the alkaline earth metal halide composition is present in an electron emissive material provided on an electrode for use within a lamp. The electron emissive material may be provided on the electrode in a number of ways including, for example, through a wet application. In one embodiment, the alkaline earth metal halide is provided on a hot cathode electrode. During lamp operation the hot cathode is heated to the "thermionic emission temperature" of the electron emissive material (e.g. the temperature at which electrons are emitted) to provide a source of electrons to support a discharge arc. Hot cathode electrodes are used in both "pre-heat" "rapid-start" and "instant start" lamps.

In preheat lamps, electrodes are heated to their emission temperature prior to ignition of the lamp by a pre-heat current. Preheat lamps typically include a starting circuit that sends increased heater current through the electrodes to heat the filament electrodes. The heater current is switched off after a discharge arc is ignited between the electrodes. The temperature necessary for free emission of electrons is maintained after ignition by ionic bombardment from the discharge.

In rapid start lamps, ballasts are used to ignite the lamps by simultaneously providing a cathode voltage (to provide heat) and an ignition voltage across the lamp. As the cathodes heat up, the voltage required to ignite the lamp is reduced. At some time after both voltages are applied, the cathodes reach a temperature sufficient for the applied voltage to ignite the lamps. In rapid start lamps, the heater current is not turned off, but continues to flow through the filament electrodes even after the discharge is ignited.

In an instant start lamp, an initial voltage many times greater than the lamp's normal operating voltage and greater than the lamp's break-down resistance is applied. The starting voltage is sometimes as high as 900 V, such that even an extremely resistant gas will conduct current. Upon ignition, the instant-start ballast will immediately regulate the voltage and current down to normal operating levels.

In another embodiment of the present invention, the electrode is a cold cathode and is heated to its emission temperature solely by the arc discharge. Cold-cathode electrodes typically rely on voltages of from about 400 to about 1000 volts between two electrodes to initiate a glow discharge. The glow discharge provides further heating of the electrodes causing an almost instantaneous transition to an arc discharge.

In certain embodiments of the present invention, electron emissive material including an alkaline earth metal halide compositions such as but not limited to halides of formula MXZ, halo oxides of formula $MX_lZ_mO_{n/2}$, halo oxy nitrides of formula $MX_bO_cN_d$, and alkali alkaline earth rare earth oxy halides of formula $A_eM_fR_gO_hX_i$ may be coated or otherwise provided on an electrode.

In some embodiments, the electron emissive material may further include metals or metal alloys. Examples of metals include but are not limited to tantalum, tungsten, thorium, titanium, nickel, platinum, vanadium, hafnium, niobium, molybdenum, and zirconium. In some embodiments, the metal, metal alloys, may be used as substrate materials. In certain other embodiments, the alkaline earth halide composition may be used along with a metal such as is a refractory metal to form a sintered composite. Refractory metals are a class of metals resistant to heat, wear and corrosion and generally have melting points greater than 1800° C.

In a further embodiment of the present invention, the electron emissive material may include an alkaline earth metal halide composition and at least one additive material (also referred to herein as an "electron emissive additive material"). Additive materials, for example, may be used as part of an electron emissive material to enable higher operational temperatures, or to enhance electron emission or to increase stability of the material. In some embodiments, the additive materials themselves may be electron emissive, however they need not be.

In a further embodiment, tantalates may be used as an electron emissive additive material. For example, electron emissive additive materials such as barium tantalate generally have a longer operating lifetime, good electron emissive characteristics with a lower evaporation rate and a high sputter resistance. Examples of tantalates include but are not limited to alkaline earth tantalates such as $M_6Ta_2O_{11}$, $M_4Ta_2O_9$, $M_5Ta_4O_{15}$, $MTa_2O_6$, $M_4Ta_4O_{14}$, $MBi_2Ta_2O_9$, $MBi_2NaTa_3O_{12}$, $M(Mg_{1/3}Ta_{2/3})O_3$, $M(Co_{1/3}Ta_{2/3})O3$, $M_6ZrTa_4O_{18}$, $M_3CaTa_2O_9$, and $M(Zn_{1/3}Ta_{2/3})O_3$.

In a further embodiment, ferroelectric oxides may be used as electron emissive additive materials. Ferroelectric oxide additive materials present in the electron emissive material may facilitate strong electron emission due to their ability to generate electrostatic charges on their polar faces. Ferroelectric oxides are characterized by high spontaneous polarization and generally contribute significantly to the electron emission through the generation of uncompensated electrostatic charges. These charges are created when their spontaneous polarization is disturbed from its equilibrium state under a pyroelectric effect, piezoelectric effect or polarization switching effect. Non-limiting examples of ferroelectric oxides include lead zirconate (PT), lead zirconate titanate (PZT), lead lanthanum zirconium titanate (PLZT) family of ferroelectrics, ferroelectric tungsten bronzes, layer-structured ferroelectrics, ferroelectric perovskites, relaxor-type ferroelectrics, ferroelectric phosphates, oxynitride perovskites, $Pb_5Ge_3O_{11}$, gadolinium molybdate, ferroelectric niobates such as $LiNbO_3$, $BaTiO_3$, lead magnesium niobate titanate, lead barium titanate, lead zirconate vanadates, lead zirconate niobate, lead zirconate tantalate, lead zirconate titanate, lithium niobate, lithium tanatalate, perovskites of the barium titanate family, bismuth containing layered structured ferroelectrics of the Aurivillius family such as bismuth titanate, bismuth strontium tantalate, and bismuth barium tantalate, and combinations thereof.

In yet another embodiment of the present invention, oxides may be used as an electron emissive additive material. Non-limiting examples of oxides include alkaline earth oxides, triple oxides such as (Ba,Ca,Sr)O and (Y,Zr,Hf) oxide, MgO, $Al_2O_3$, $Y_2O_3$, alkaline earth tungsten oxides, $Y_2O_3$, $La_2O_3$, $ThO_2$, $Al_2O_3$, MgO, $ZrO_2$, and ZnO.

In certain other embodiments, electron emissive additive materials may include zirconates, titanates, aluminates, lanthanates or phosphates. Non-limiting examples of such electron emissive additive materials include $MZrO_3$, $MWO_4$, $MHfO_3$, $MTiO_3$, $M_2TiO_4$, $M_3Y_4O_9$, $MY_2O_4$, $MCeO_3$, $M_4CaAl_2O_8$, $MSc_4O_7$, $MLa_2O_4$, $MAl_2O_4$, and $MSiO_3$, $M_2NaNb_5O_{15}$, $M_{0.5}Sr_{0.5}Nb_2O_6$, $M_2Bi_2O_5$, $M_3LaNb_3O_{12}$, $MBiO_3$, $M(Pb_{1-x}Bi_x)O_3$, $M_{1-x}A_xBiO_3$, $M_3Ln(PO_4)_3$, and $MBi_2Nb_2O_9$, $MZr_4P_6O_{24}$, $MB_2O_4$ and $M_2MgGe_2O_6$.

Electron emissive additive materials may include materials with high melting points, for example, having melting points greater than 1000° C. Such materials may be desirably used in lamps with cathode temperatures greater than 800° C. for electron emission. Non-limiting examples of high melting point materials include barium orthoarsenate ($Ba_2(AsO_4)_2$, Barium molybdate, ($BaMoO_4$), Barium sulphate ($BaSO_4$), Barium sulphide (BaS), strontium sulphate ($SrSO_4$), strontium sulphide (SrS), calcium chloride fluoride orthophosphate ($3Ca_3(PO_4)_2.CaClF$), calcium nitride ($Ca_3N_2$), calcium orthophosphate ($Ca_3(PO_4)_2$), calcium pyrophosphate ($Ca_2P_2O_7$), and calcium phosphide ($Ca_3P_2$).

In certain embodiments, the alkaline earth metal halide composition of the present invention may be present in a range from about 1% to about 100% by weight of the total electron emissive material. In other embodiments, the alkaline earth metal halide composition may be present in a range from about from about 25% to about 75% by weight of the total electron emissive material. In certain other embodiments the alkaline earth metal halide may be present in a range from about 40% to about 60% by weight of the total electron emissive material.

Various embodiments of electrodes are depicted in the FIGS. 1-5. These embodiments illustrate how electron emissive materials such as those described herein may be utilized in various cathode configurations. The applications of the electron emissive materials described herein are not intended to be limited to the depicted embodiments.

Figure 2:
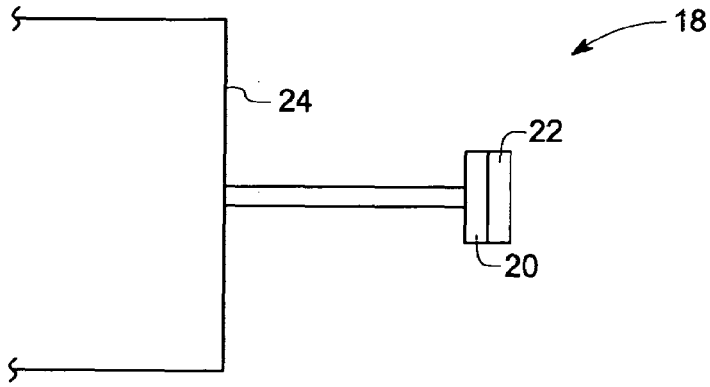
FIG. 2 is a side cross-sectional view of a flat member cathode having the electron emissive material in accordance with certain embodiments of the present invention.
Figure 3:
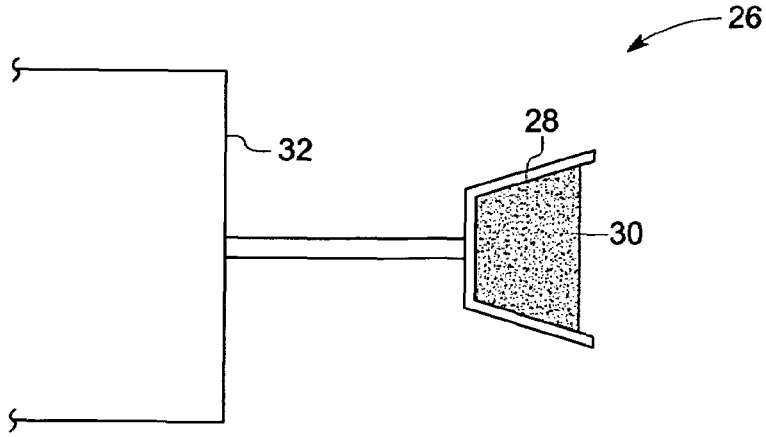
FIG. 3 is a side cross-sectional view of a cup shaped cathode having the electron emissive material in accordance with certain embodiments of the present invention.

As illustrated in FIG. 1, the cathode 10 may comprise a metal wire or a metal coil 12, such as a tungsten coil, with an electron emissive material coating 14, coupled to ballast 16. Ballasts are typically used to provide and regulate the necessary electric current to an electrode. Alternatively as shown in FIG. 2, the cathode 18 may comprise a flat component 20 containing the electron emissive material 22 (such as in the form of a coating) on at least one surface coupled to ballast 24. In the illustrated embodiment shown in FIG. 3, the cathode 26 includes a cup shaped structure 28 containing the electron emissive material 30 inside the hollow interior space of the cup. In some embodiments, the electron emissive material 30 may be operably coupled to the cup shaped structure 28 by sintering the cup 28 and the material 30 together. The cathode may be further coupled to ballast 32.

Figure 4:
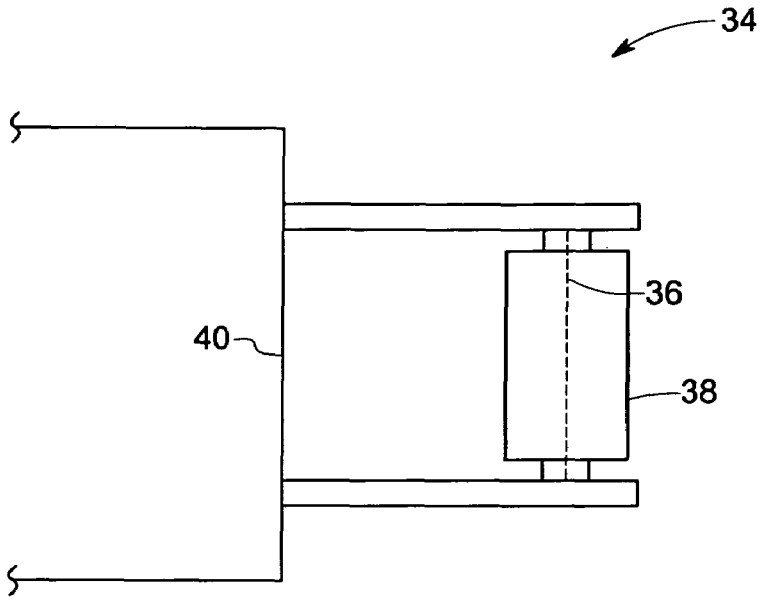
FIG. 4 is a side cross-sectional view of a cathode having the electron emissive material in accordance with certain embodiments of the present invention.
Figure 5:
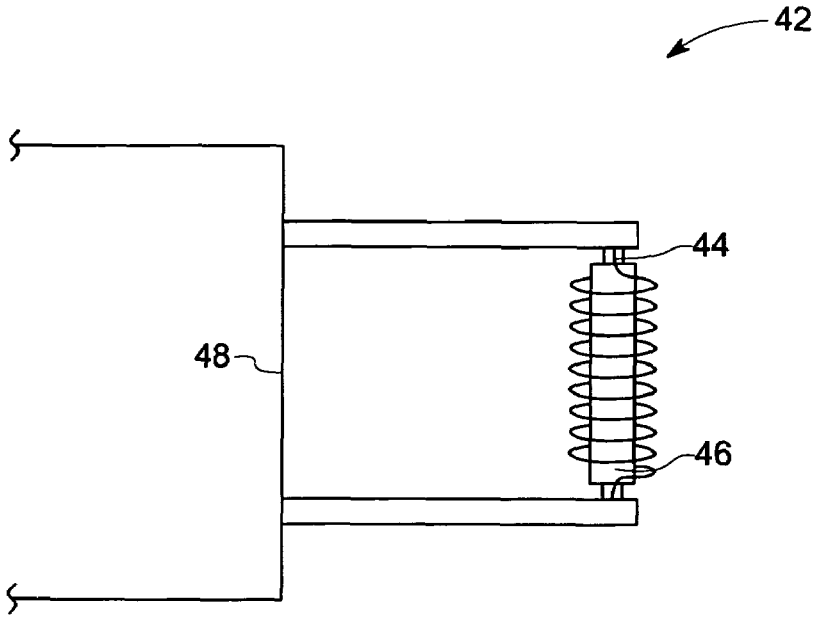
FIG. 5 is a side cross-sectional view of a cathode having the electron emissive material in accordance with certain embodiments of the present invention.

In the illustrated embodiment shown in FIG. 4, the cathode 34 includes a wire 36 such as a tungsten wire, disposed within a solid composite 38 including the electron emissive material. The cathode may be further coupled to a ballast 40. In the illustrated embodiment shown in FIG. 5, the cathode 42 may include a wire 44 such as a tungsten wire, coiled around a solid composite 46 including the electron emissive material 46. The cathode may be further coupled to a ballast.

Figure 6:
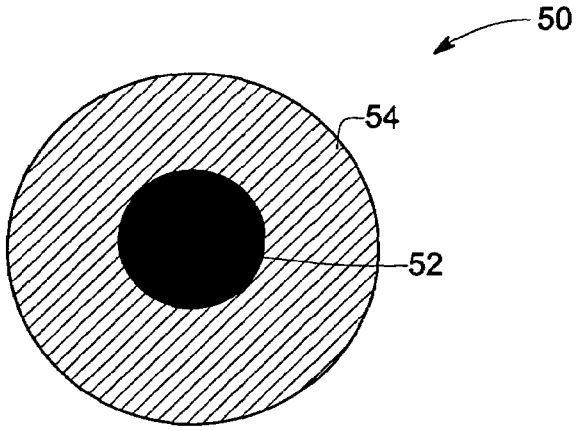
FIG. 6 is a cross-sectional view of an electron emissive material in accordance with certain embodiments of the present invention.
Figure 7:
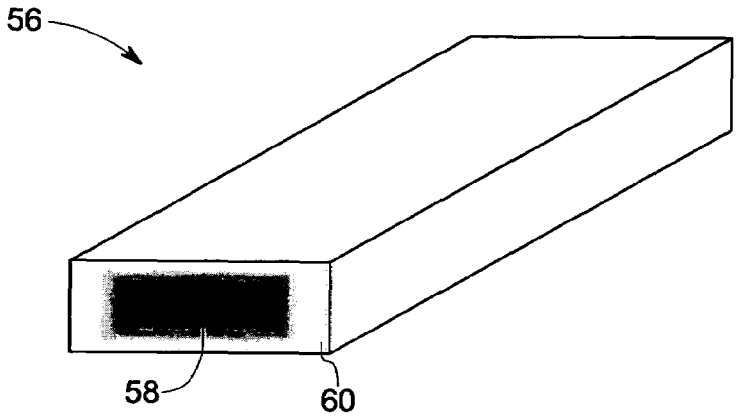
FIG. 7 is a side cross-sectional view of a coating including the electron emissive material in accordance with certain embodiments of the present invention.

Further, the electron emissive materials may be utilized in different forms as shown in FIGS. 6-10. In some electrode embodiments, the electron emissive material may be present as particles 50 comprising a core material 52 and a shell material 54 as shown in FIG. 6. In a non-limiting example, the core material comprises an alkaline earth metal halide composition and the shell material comprises an alkaline earth metal free composition. In another non-limiting example, the core material comprises a triple oxide composition, such as (Ba,Sr,Ca)O, and the shell material comprises an alkaline earth metal halide composition In other electrode embodiments, the electron emissive material is disposed as a graded composite structure 56 of ceramic and metal as shown in the illustrated embodiment in FIG. 7. In a non-limiting example, the center 58 of the composite structure may be made with greater than 50% alkaline earth metal halide concentration per unit volume and the outer edges 60 may be made with greater than 50% tungsten metal concentration per unit volume.

Figure 8:
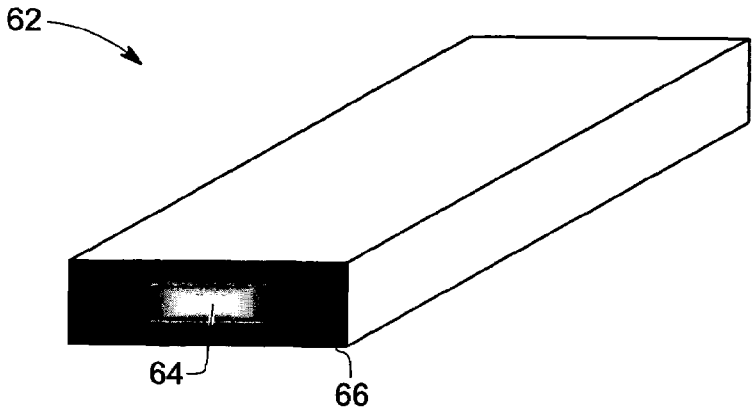
FIG. 8 is a side cross-sectional view of a coating including the electron emissive material in accordance with certain embodiments of the present invention.

In another embodiment, the electron emissive material may be disposed on an electrode as a graded sintered ceramic structure 62 as shown in FIG. 8. In a non-limiting example, the barium concentration per unit volume in the sintered ceramic 62 increases radially from the core 64 towards the outer edges 66.

Figure 9:
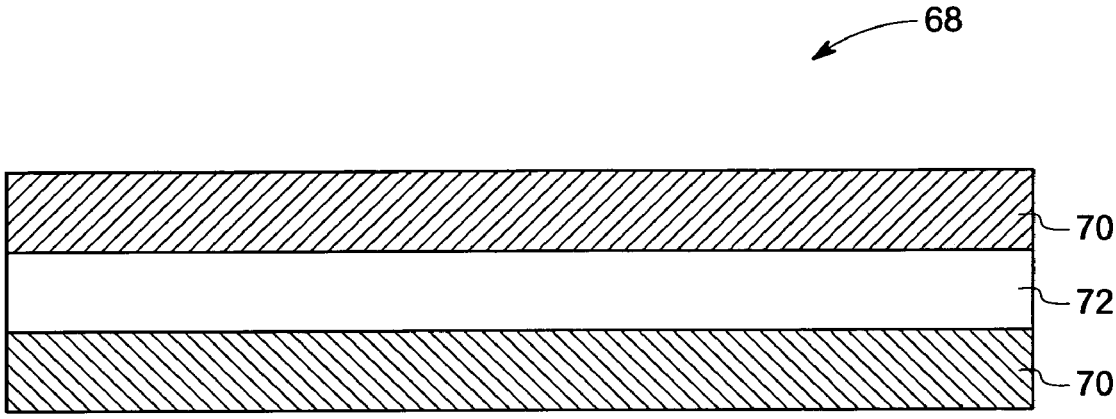
FIG. 9 is a cross-sectional view of an electron emissive material in accordance with certain embodiments of the present invention.
Figure 10:
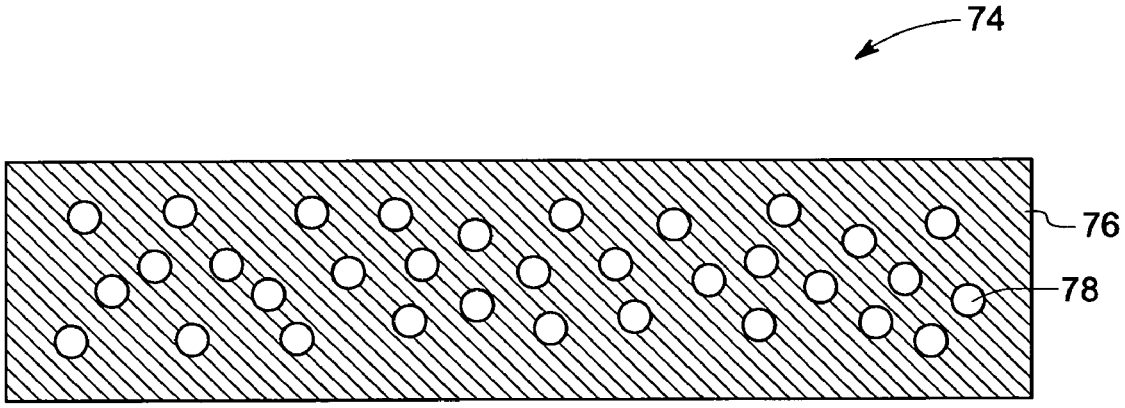
FIG. 10 is a side cross-sectional view of a linear fluorescent lamp employing an electron emissive material in accordance with embodiments of the present invention.

In still another embodiment of the present invention, an electrode 68 may comprise a multilayered structure as shown in FIG. 9. In a non-limiting example, a low alkaline earth content layer 70 alternates with a high alkaline earth content layer 72.

In yet another embodiment of the present invention, an electrode 74 may include an electron emissive material 78 embedded inside the pores of a porous refractory material 76. Refractory materials include but are not limited to tungsten and tantalum.

In a further embodiment of the present invention, an electrode comprising an electron emissive material including an alkaline earth halide composition is disposed within a lamp having an envelope and a discharge material disposed therein. Non-limiting examples of lamps suitable for use in accordance with teachings of the present invention include linear fluorescent lamps, compact fluorescent lamps, circular fluorescent lamps, high intensity discharge lamps, flat panel displays, mercury free lamps or xenon lamps.

Discharge lamps typically include an envelope containing a gas discharge material through which a gas discharge takes place, and typically two metallic electrodes that are sealed in the envelope. While a first electrode supplies the electrons for the discharge, a second electrode provides the electrons with a path to the external current circuit. Electron emission generally takes place via thermionic emission although it may alternatively be brought about by an emission in a strong electric field (field emission), or directly, via ion bombardment (ion-induced secondary emission).

In one embodiment of the present invention, alkaline earth metal halide compositions may desirably be used in discharge lamps. For example, the melting temperature of $BaF_2$ may be about 1355° C., of $CaCl_2$ may be about 1600° C., of $SrF_2$ may be about 1473° C., of $CaF_2$ may be about 1423° C., of $SrCl_2$ may be about 875° C. and of $3Ca_3(PO_4)_2.CaClF$ may be about 1270° C., enabling their usage in discharge lamps even under conditions of cathode operating temperatures greater than 800° C.

Non-limiting examples of discharge materials suitable for use in a lamp equipped with an electron emissive material including a alkaline earth metal halide composition may include metals, such as but are not limited to Hg, Na, Zn, Mn, Ni, Cu, Al, Ga, In, Tl, Sn, Pb, Bi, Ti, V, Cr, Zr, Nb, Mo, Hf, Ta, W, Re, or Os or any combinations thereof. Other discharge materials suitable for use in a lamp equipped with an alkaline earth metal electron emissive material also include rare gases such as but not limited to neon and argon. Still other discharge materials include but are not limited to compounds such as halides or oxides or chalcogenides or hydroxide or hydride, or organometallic compounds or any combinations thereof of metals such as but not limited to Hg, Na, Zn, Mn, Ni, Cu, Al, Ga, In, Tl, Ge, Sn, Pb, Bi, Ti, V, Cr, Zr, Nb, Mo, Hf, Ta, W, Re, or Os or any combinations thereof. Non-limiting examples of metal compounds include zinc halide, gallium iodide, and indium iodide.

Figure 11:
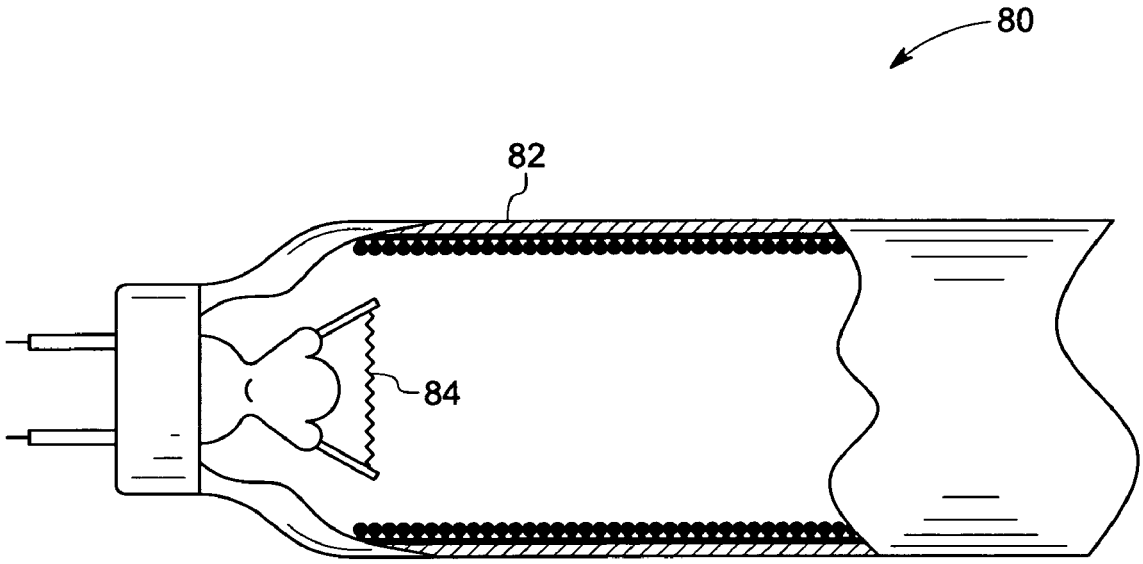
FIG. 11 is a side cross-sectional view of a compact fluorescent lamp employing an electron emissive material in accordance with embodiments of the present invention.
Figure 12:
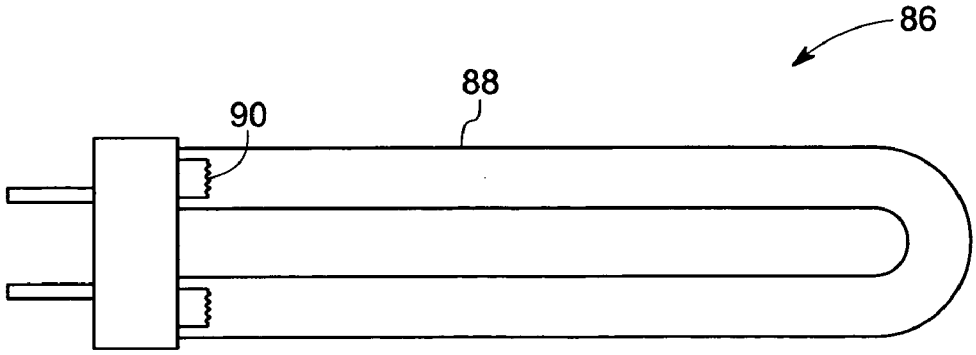
FIG. 12 is a top cross-sectional view of a circular fluorescent lamp employing an electron emissive material in accordance with embodiments of the present invention.
Figure 13:
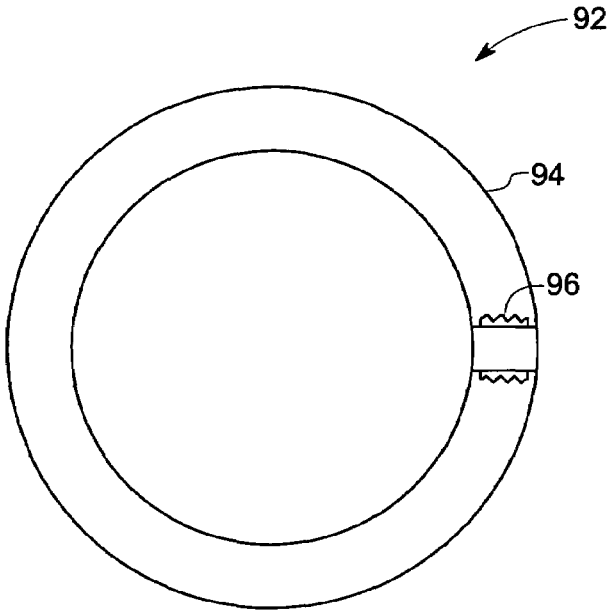
FIG. 13 is a side cross-sectional view of a high pressure fluorescent lamp employing an electron emissive material in accordance with embodiments of the present invention.
Figure 14:
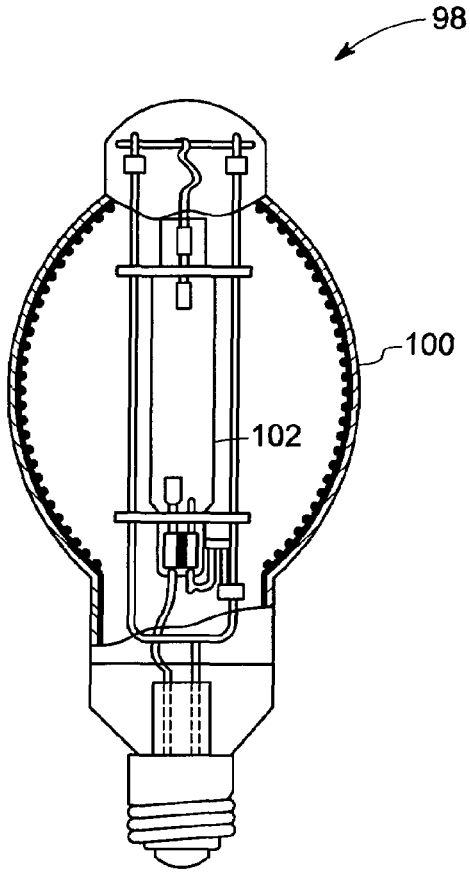
FIG. 14 is a side cross-sectional view of a high-pressure fluorescent lamp employing an electron emissive material in accordance with embodiments of the present invention.

In some embodiments, an alkaline earth metal halide electron emissive material may be provided in a fluorescent lamp including a cathode, a ballast, a discharge material and an envelope or cover containing the discharge material. The fluorescent lamp may comprise a linear fluorescent lamp 80 as illustrated in FIG. 11 with an envelope 82 and an electrode with the electron emissive material 84, or a compact fluorescent lamp 86 with an envelope 88 and an electrode with the electron emissive material 90 as illustrated in FIG. 12. The lamp may also be a circular fluorescent lamp 92 with an envelope 94 and an electrode with the electron emissive material 96, as illustrated in FIG. 13. Alternatively, the lamp may comprise a high-pressure lamp or high intensity discharge lamp 98, including an arc envelope 102 inside an outer housing 100 as illustrated in FIG. 14.

In certain embodiments of the present invention, at least one constituent halogen in the halide discharge material and at least one constituent halogen in the alkaline earth halide electron emissive material, are of the same type. In a non-limiting example, a barium fluoriodide electron emissive material is used in a lamp with. a zinc iodide discharge material. Combinations of such electron emissive materials and discharge materials are expected to avoid deleterious reactions and provide a stable discharge. For example, first principle calculations at 0° K indicate that for a barium oxide-zinc iodide (discharge material) forward reaction where barium oxide is the electron emissive material and zinc iodide is the discharge material, the enthalpy is negative, indicating that the forward reaction is feasible. As such, a system comprising these materials may not be stable. In contrast, the enthalpy of reaction for a barium fluoroiodide-zinc iodide forward reaction where barium fluoroiodide is the electron emissive material and zinc iodide is the discharge material, the enthalpy is positive (+122.67 kJ/mol), indicating that the forward reaction is not feasible. Thus, a system comprising fluoroiodide-zinc iodide may be expected to remain stable. The stability may be attributed to the common ion effect, whereby the discharge medium and the electron emissive medium each have at least one halogen-which is of the same type as the other.

In still another embodiment of the present invention is a method of manufacturing an electron emissive system. The method includes blending an alkaline earth metal halide composition with a binder to form a slurry, coating the slurry on a thermal or electrical excitation source or an electrode substrate such as a tungsten filament, and removing the binder. In a non-limiting example, the binder is removed by firing at a high temperature in an appropriate atmosphere at an optimized heating rate.

The electron emissive material can be manufactured by various processing methods utilized in the fields of ceramics and metallurgy, which generally permit good control over particle size and crystallinity. Suitable examples of such manufacturing processes are the reactive milling method, sol-gel method, wet chemical precipitation, molten-salt synthesis and mechano-chemical synthesis.

The metal compounds used in the preparation of the alkaline earth halide composition may be ground up into the desired particle sizes using a combination of shear and compressive forces in devices such as ball mills, Henschel mixers, Waring blenders, roll mills, and the like. The metal compounds may be ground up for a time period effective to produce particles of about 0.4 to about 8 micrometers. In some embodiments, the particle size may be greater than or equal to about 0.8 micrometers. In other embodiments, the particle size may be greater than or equal to about 1 micrometer. In certain other embodiments, the particle size may be greater than or equal to about 1.5 micrometers. Other embodiments may include of particles size less than or equal to about 5 micrometers. Some other embodiments may include particles of size less than or equal to about 5 micrometers.

The powders of the precursor compositions are generally first mechanically milled if desired, to form an electron emissive precursor composition having particles of a desired size. The particles of the electron emissive precursor composition are then blended with a binder and optionally a solvent to form a wet mixture. Mechanical milling may continue during the formation of the wet mixture. The wet mixture as may be a slurry, suspension, solution, paste, or the like. The wet mixture may be then coated onto a desired substrate, following which it is optionally allowed to dry to form a green coating. In some embodiments, the green coating may be a coating which generally has less than or equal to about 10 wt % solvent based upon the weight of the wet mixture. In some embodiments, less than or equal to about 5 wt % solvent may be present. In some other embodiments, less than 3 wt % solvent may be present. In certain embodiments, less than or equal to about 2 wt % solvent based on the total weight of the wet mixture may be present. The substrate with the coating may be annealed to facilitate the sintering of the coating to form the electron emissive material. In one embodiment, a composite comprising the alkaline earth halide electron emissive material can be disposed as a thin or a thick film on a tungsten substrate through a sol-gel process or other physical and/or chemical thin-film deposition methods.

Binders used in the preparation of the mixture typically are polymeric resins, ceramic binders, or combinations comprising polymeric resins and ceramic binders. Non-limiting examples of ceramic binders are aluminum phosphate ($AlPO_4$), silica ($SiO_2$), and magnesia (MgO). Polymeric resins used in the preparation of the wet mixture may be thermoplastic resins, thermosetting resins or combinations of thermoplastic resins with thermosetting resins. The thermoplastic resins may be oligomers, polymers, copolymers such as block copolymers, graft copolymers, random copolymers, star block copolymers, dendrimers, polyelectrolytes, ionomers or the like, or combinations comprising at least one of the foregoing thermoplastic resins. Suitable examples of thermoplastic resins are polyacetal, polyacrylic, styrene acrylonitrile, acrylonitrile-butadiene-styrene (ABS), polycarbonates, polystyrenes, polyethylene, polypropylenes, polyethylene terephthalate, polybutylene terephthalate, polyamides, polyamideimides, polyarylates, polyurethanes, polyetherimide, polytetrafluoroethylene, fluorinated ethylene propylene, perfluoroalkoxy polymers, polyethers such as polyethylene glycol, polypropylene glycol, or the like; polychlorotrifluoroethylene, polyvinylidene fluoride, polyvinyl fluoride, polyetherketone, polyether etherketone, polyether ketone ketone, nitrocellulose, cellulose, lignin, or the like, or combinations comprising at least one of the foregoing thermoplastic resins. In certain embodiments thermoplastic resin may be nitrocellulose.

It is generally desirable to use thermoplastic resins having a number average molecular weight of about 1000 grams per mole (g/mole) to about 500,000 g/mole. Within this range, it may be desirable to use a thermoplastic resin having a number average molecular weight of greater than or equal to about 2,000. In certain embodiments the number average molecular weight may be greater than or equal to about 3,000. In certain other embodiments, the number average molecular weight may be greater than or equal to about 4,000 g/mole. In some embodiments, the number average molecular weight may be less than or equal to about 200,000. In other embodiments, the number average molecular weight may be less than or equal to about 100,000. In still other embodiments, the number average molecular weight may be less than or equal to about 50,000 g/mole.

Examples of blends of thermoplastic resins include acrylonitrile-butadiene-styrene/nylon, polycarbonate/acrylonitrile-butadiene-styrene, acrylonitrile butadiene styrene/polyvinyl chloride, polyphenylene ether/polystyrene, polyphenylene ether/nylon, polycarbonate/thermoplastic urethane, polycarbonate/polyethylene terephthalate, polycarbonate/polybutylene terephthalate, polyethylene terephthalate/polybutylene terephthalate, styrene-maleicanhydride/acrylonitrile-butadiene-styrene, polyethylene/nylon, polyethylene/polyacetal, or the like, or combinations comprising at least one of the foregoing blends of thermoplastic resins.

Specific non-limiting examples of polymeric thermosetting materials include polyurethanes, epoxy, phenolic, polyesters, polyamides, silicones, or the like, or combinations comprising at least one of the foregoing thermosetting resins.

Ceramic binders may also be used in the preparation of the wet mixture. Examples of ceramic binders are aluminum phosphate, zirconia, zirconium phosphate, silica, magnesia and the like. In some embodiments, binders may be used in an amount of about 5 wt %, to about 50 wt % based on the total weight of the wet mixture. In certain embodiments, binders may be generally present in the wet mixture in an amount of greater than or equal to about 8 wt %. In other embodiments binders may be present in an amount greater than or equal, to about 10 wt %. In still other embodiments the binder may be present in an amount greater than or equal to about 12 wt % based on the total weight of the wet mixture. Some other embodiments include binders present in the wet mixture in an amount of less than or equal to about 45 wt %. In certain embodiments, the binders may be present in an amount less than or equal to about 40 wt %. In still other embodiments the binders may be present in an amount less than or equal to about 35 wt % based on the total weight of the wet mixture.

Solvents may optionally be used in the preparation of the wet mixture. Liquid aprotic polar solvents such as propylene carbonate, ethylene carbonate, butyrolactone, acetonitrile, benzonitrile, nitromethane, nitrobenzene, sulfolane, dimethylformamide, N-methylpyrrolidone, butyl acetate, amyl acetate, methyl propanol or propylene glycol mono-methyl ether acetate with denatured ethanol, or the like, or combinations comprising at least one of the foregoing solvents may generally be used in the preparation of the wet mixture. Polar protic solvents such as water, methanol, acetonitrile, nitromethane, ethanol, propanol, isopropanol, butanol, or the like, or combinations comprising at least one of the foregoing polar protic solvents may also be used in the preparation of the wet mixture. Other non-polar solvents such a benzene, toluene, methylene chloride, carbon tetrachloride, hexane, diethyl ether, tetrahydrofuran, or the like, or combinations comprising at least one of the foregoing solvents may also be used in the preparation of the wet mixture. Co-solvents comprising at least one aprotic polar solvent and at least one non-polar solvent may also be utilized to prepare the wet mixture. Ionic liquids may also be utilized for preparing the wet mixture. In some embodiments, the solvent may be bepropylene glycol mono-methyl ether acetate with denatured ethanol. In a non-limiting example, the solvent comprises about 90 wt % to about 95 wt % of propylene glycol mono-methyl ether acetate with about 1 wt % to about 2 wt % of the denatured alcohol.

The solvent is generally used in an amount of about 5 wt % to about 60 wt % based on the total weight of the wet mixture. Within this range, the solvent is generally present in the wet mixture in an amount of greater than or equal to about 8 wt %. In some embodiments, the solvent may be present in an amount greater than or equal to about 10 wt %. In other embodiments, the solvent is present in an amount greater than or equal to about 12 wt % based on the total weight of the wet mixture. Within this range, the solvent may be generally present in the wet mixture in an amount of less than or equal to about 48 wt %. In some embodiments, the solvent may be present in an amount less than or equal to about 45 wt %. In certain embodiments, the solvent may be present in an amount less than or equal to about 40 wt % based on the total weight of the wet mixture.

The wet mixture may be generally coated onto a desired substrate such as a tungsten wire or sheet and then sintered. The coating of the substrate may be carried out by processes such as dip coating, spray painting, electrostatic painting, painting with a brush, or the like. In one embodiment, the electron emissive material coating thickness may be from about 3 micrometers to about 100 micrometers after sintering. In another embodiment, the coating thickness may be from about 10 micrometers to about 80 nanometers. In a still another embodiment, the coating thickness may from about 15 micrometers to about 60 micrometers.

The coated substrate may be generally subjected to a sintering process to remove the solvent and binder and to form a coating of the electron emissive material on the substrate. The sintering process may be conducted by heating process such as conduction, convection, radiation such as radio frequency radiation or microwave radiation. In another embodiment, the electrode may be resistively heated to sinter the wet mixture to form the electron emissive material. Combinations of different methods of heating for purposes of sintering, such as, for example, convective heating in combination with resistive heating may also be used if desired. The sintering process by conduction, convection, radiation, resistive heating or combinations thereof may be carried out at a temperature of about 1000° C. In certain embodiments of the present invention, the sintering may be conducted in a two-stage process if desired. In the first stage the binder may be eliminated by heating the green coating to a temperature of about 300° C. to about 400° C. for about 10 to about 60 minutes. In the second stage the material may be sintered to a temperature of about 1000.degree. C. to about 1700.degree. C.

The substrate may have any desired shape. It may be 1-dimensional, 2-dimensional or 3-dimensional or any suitable fractional dimension up to about 3. Suitable examples of 1 dimensional substrate are linear filaments, non-linear filaments such as circular filaments, elliptical filaments, coiled filaments or the like. Suitable examples of 2-dimensional substrates are flat plates, flat or curved sheets, and the like. Suitable examples of 3-dimensional substrates are hollow spheres, cups, beads, and the like. It may also be possible to use substrates having a combination of 1, 2, or 3-dimensional geometries. Non-limiting example of a substrate is a tungsten filament. In one embodiment, the substrate may be an electrode in a lamp. The electrode may be an anode, a cathode, or both an anode and a cathode in a lamp.

In another embodiment, the alkaline earth metal halide composition, and tungsten powders may be sintered to a high density and used as a composite sintered electrode. Such a composite sintered electrode may desirably offer significant flexibility in the positioning of the cathode within the lamp and allows lamp design flexibility such as fluorescent tubes of narrower diameter.

In some embodiments, providing an electron emissive material includes providing an impregnated electrode. The electrode material may be embedded into the pores of a porous refractory metal such as tungsten or tantalum.

In a still further embodiment of the present invention is a method including thermally or electrically exciting an electron emissive material including an alkaline earth halide composition disposed within a lamp, by operably coupling the lamp to an excitation source and supplying thermal or electrical energy to cause the electron emissive material to emit electrons. A non-limiting example of energizing the excitation source may be by coupling to an alternating current (AC)

or direct current (DC) power supply. In a non-limiting example, a barium iodide emissive material may be used in an indium iodide discharge material lamp.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An electrode comprising an electron emissive material, wherein the electron emissive material comprises an alkaline earth metal halide compound of formula (I), (II), (III) or (IV), wherein $$MXZ, \quad (I)$$

wherein M is at least one alkaline earth metal selected from the group consisting of magnesium, calcium, strontium, barium, and combinations thereof, X is a first halogen selected from the group consisting of fluorine, chlorine, bromine iodine, and combinations thereof and Z is a second halogen different from the first halogen and selected from group consisting of fluorine, chlorine, bromine, iodine and combinations thereof;

$$MX_lZ_mO_{n/2} \quad (II)$$

wherein M is at least one alkaline earth metal selected from the group consisting of magnesium, calcium, strontium, barium and combinations thereof, X is at least one halogen selected from the group consisting of fluorine, chlorine, bromine, iodine and combinations thereof, Z is at least one halogen different from the first halogen and selected from group consisting of fluorine, chlorine, bromine, iodine and combinations thereof, wherein l, m, and n is selected to maintain charge balance and where l is selected to be in a range from greater than or equivalent to 0 to less than or equivalent to 2, m is selected to be in a range from greater than or equivalent to 0 to less than or equivalent to 1, and n is selected to be less than or equivalent to 0.5;

$$MX_bO_cN_d \quad (III)$$

wherein M is at least one alkaline earth metal selected from the group consisting of magnesium, calcium, strontium, barium and combinations thereof, X is at least one halogen selected from the group consisting of fluorine, chlorine, bromine, iodine and combinations thereof where b, c, d is selected to maintain charge balance and b is be selected to be in a range from greater than 0 to about 2, c is selected to be in a range from 0 to about 1, and d is selected to be in a range from 0 to about 1; and $$A_eM_fR_gO_hX_i \quad (IV)$$

wherein A is at least one alkali metal selected from the group consisting of sodium, potassium, and combinations thereof, M is at least one alkaline earth metal selected from the group consisting of magnesium, calcium, strontium, barium and combinations thereof, R is a metal selected from the group consisting of La, Ce, Pr, Nd, Pm, Sm, Eu, Gd, Tb, Dy, Ho, Er, Tm, Yb, Lu, Y, Sc, and combinations thereof X is at least one halogen selected from the group consisting of fluorine, chlorine, bromine, iodine and combinations thereof where e, f, g, h, I, is selected to maintain charge balance and e may be selected to be in a range from 0 to about 3, f may be selected to be in a range from greater than 0 to about 4, g may be selected to be in a range from about 0 to about 3, h may be selected to be in a range from 0 to about 1 and i may be selected to be in a range from about 2 to about 11.

2. The electrode of claim 1, wherein the alkaline earth metal halide compound has a formula of MXZ, wherein M is an alkaline earth metal selected from the group consisting of magnesium, calcium, strontium, barium and combinations thereof, X is a first halogen selected from a group consisting of fluorine, chlorine, bromine, iodine and combinations thereof, and Z is a second halogen different from the first halogen and selected from group consisting of fluorine, chlorine, bromine, iodine and combinations thereof.

3. The electrode of claim 1, wherein the alkaline earth metal halide compound has a formula of MXbOcNd.

4. The electrode of claim 1, wherein the alkaline earth metal halide compound has a formula of $A_eM_fR_gO_hX_i$.

5. The electrode of claim 1, wherein the alkaline earth metal halide compound comprises $3M_3(PO4)_2.MClF$.

6. The electrode of claim 1, wherein the electron emissive material further comprises at least one additive material selected from the group consisting of metals, tantalates, ferroelectric oxides, halides, oxyhalides and combinations thereof.

7. The electrode of claim 1, wherein the electron emissive material comprises particles comprising a core material and a shell material.

8. The electrode of claim 7, wherein the core material comprises the alkaline earth metal halide compound and the shell material comprises an alkaline earth metal free composition.

9. The electrode of claim 7, wherein the core material comprises a triple oxide compound and the shell material comprises an alkaline earth metal halide composition.

10. The electrode of claim 1, wherein the electron emissive material is disposed in a ceramic or metal cup.

11. The electrode of claim 1, wherein the electron emissive material is disposed as a coating on a planar metal foil or a metal filament.

12. The electrode of claim 1, further comprising a metal coil wrapped around a core structure including the electron emissive material.

13. The electrode of claim 1, wherein the electrode comprises a sintered solid composite comprising the electron emissive material.

14. The electrode of claim 13, wherein the sintered solid composite is multilayered.

15. The electrode of claim 1, wherein the electrode comprises a graded structure.

16. The electrode of claim 15, wherein the graded structure comprises a sintered composite of the electron emissive material and at least one metal.

17. The electrode of claim 15, wherein the concentration per unit volume of the alkaline earth metal halide continuously increases from the surface of the electrode to the core of the electrode.

18. The electrode of claim 1, wherein the alkaline earth metal halide composition is embedded inside pores of a porous refractory material.

* * * * *

UNITED STATES PATENT AND TRADEMARK OFFICE

CERTIFICATE OF CORRECTION

PATENT NO. : 7,652,415 B2
APPLICATION NO. : 11/254991
DATED : January 26, 2010
INVENTOR(S) : Ramachandran et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1133 days.

Signed and Sealed this

Twenty-eighth Day of December, 2010

David J. Kappos

David J. Kappos
*Director of the United States Patent and Trademark Office*